US007673750B1

(12) United States Patent
Huckert

(10) Patent No.: US 7,673,750 B1
(45) Date of Patent: Mar. 9, 2010

(54) EDUCATIONAL FOOD DISH SYSTEM

(76) Inventor: Brent K. Huckert, 3035 Whispering Willow Way, Orange Park, FL (US) 32065

( * ) Notice: Subject to any disclaimer, the term of this patent is extended or adjusted under 35 U.S.C. 154(b) by 98 days.

(21) Appl. No.: 11/968,482

(22) Filed: Jan. 2, 2008

(51) Int. Cl.
*B65D 85/00* (2006.01)

(52) U.S. Cl. ..... 206/459.1; 206/542

(58) Field of Classification Search ..... 206/459.5, 206/459.1, 457, 541, 542; 40/324, 649
See application file for complete search history.

(56) References Cited

U.S. PATENT DOCUMENTS 2,224,683 A * 12/1940 Ide et al. ..... 40/324
2,861,367 A * 11/1958 Chanslor ..... 40/324
3,514,887 A * 6/1970 Jacob ..... 40/324
4,908,066 A 3/1990 Taylor et al.
D306,949 S 4/1990 Gebhardt
4,936,462 A 6/1990 Yuen
5,477,979 A * 12/1995 Goessling et al. ..... 220/713
5,560,653 A 10/1996 Beppu
6,149,011 A 11/2000 Csengeri et al.
6,296,488 B1 10/2001 Brenkus et al.
2005/0045113 A1 3/2005 Wetterer et al.

* cited by examiner

*Primary Examiner*—Jacob K Ackun, Jr.

(57) ABSTRACT

An educational food dish system includes a food supporting member that includes a housing defining a base wall of the food supporting member. The housing includes a top wall, a bottom wall and a perimeter wall extending between the top and bottom walls. The perimeter wall has a slot therein. The top wall is comprised of a transparent material. A plate has an upper surface, a lower surface and an outer edge. The plate is removably positioned between the top and bottom walls. Educational indicia are positioned on the upper surface.

7 Claims, 5 Drawing Sheets

EDUCATIONAL FOOD DISH SYSTEM

BACKGROUND OF THE INVENTION

1. Field of the Invention

The present invention relates to educational devices and more particularly pertains to a new educational device for educating a child while the child eats.

2. Summary of the Invention

The present invention meets the objectives presented above by generally comprising a food supporting member that includes a housing defining a base wall of the food supporting member. The housing includes a top wall, a bottom wall and a perimeter wall extending between the top and bottom walls. The perimeter wall has a slot therein. The top wall is comprised of a transparent material. A plate has an upper surface, a lower surface and an outer edge. The plate is removably positioned between the top and bottom walls. Educational indicia are positioned on the upper surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
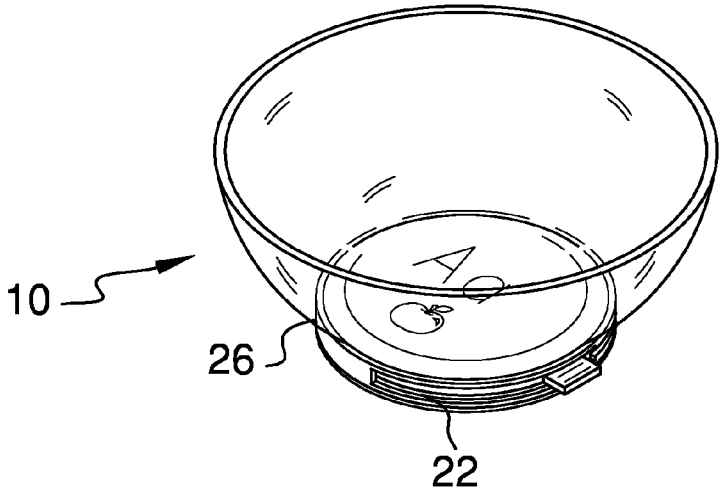
FIG. 1 is a perspective view of an educational food dish system according to the present invention.
Figure 2:
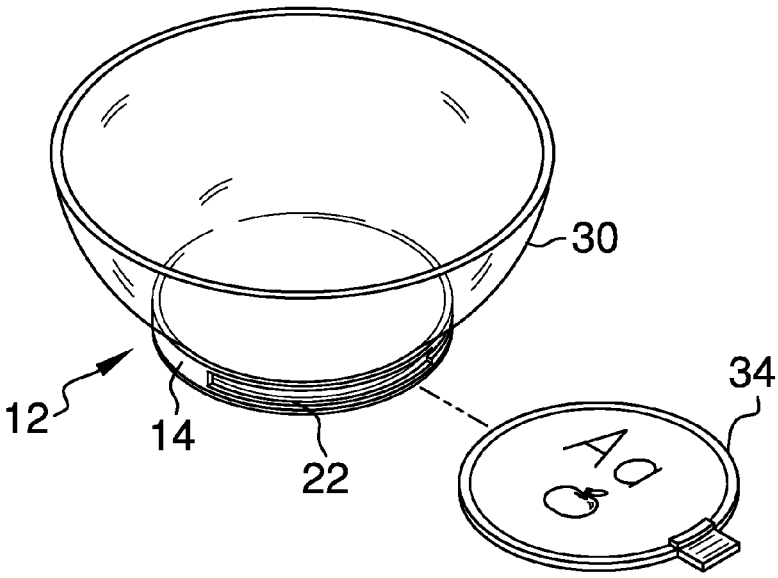
FIG. 2 is a perspective view of the present invention.
Figure 3:
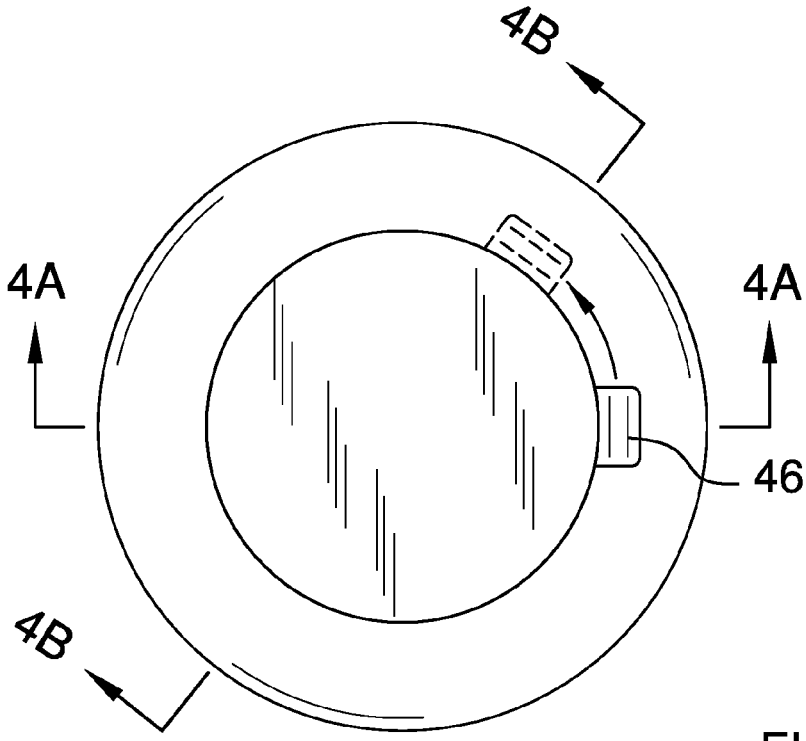
FIG. 3 is a bottom view of the present invention.
Figure 4A:
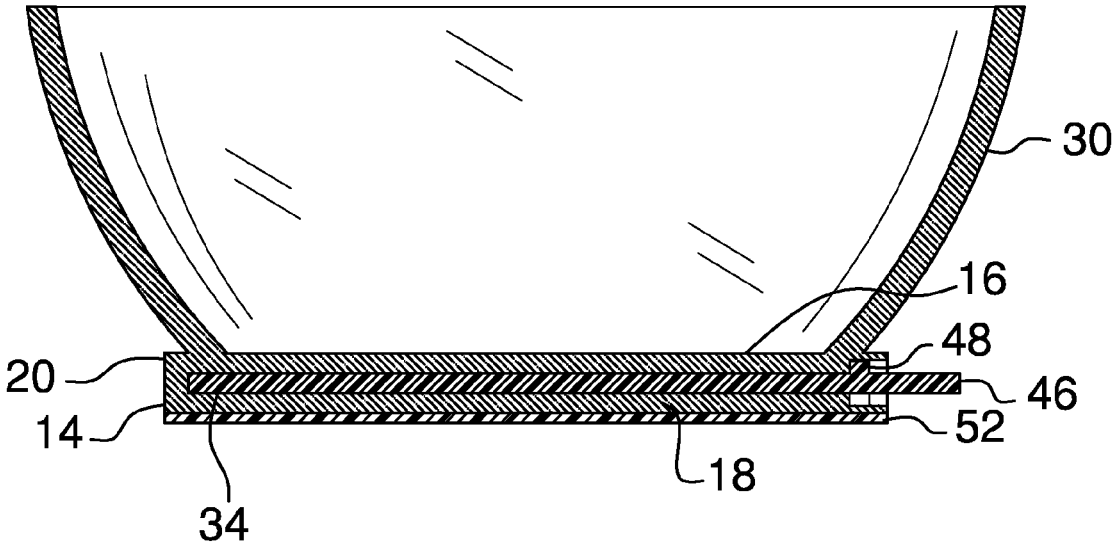
FIG. 4A is a cross-sectional view taken along line 4A-4A of FIG. 3 of the present invention.
Figure 4B:
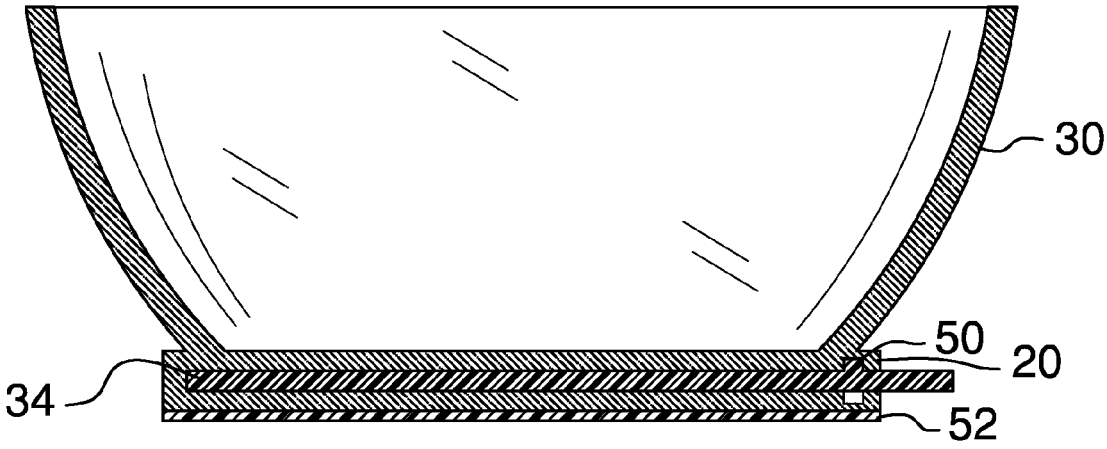
FIG. 4B is a cross-sectional view taken along line 4B-4B of FIG. 3 of the present invention.
Figure 5:
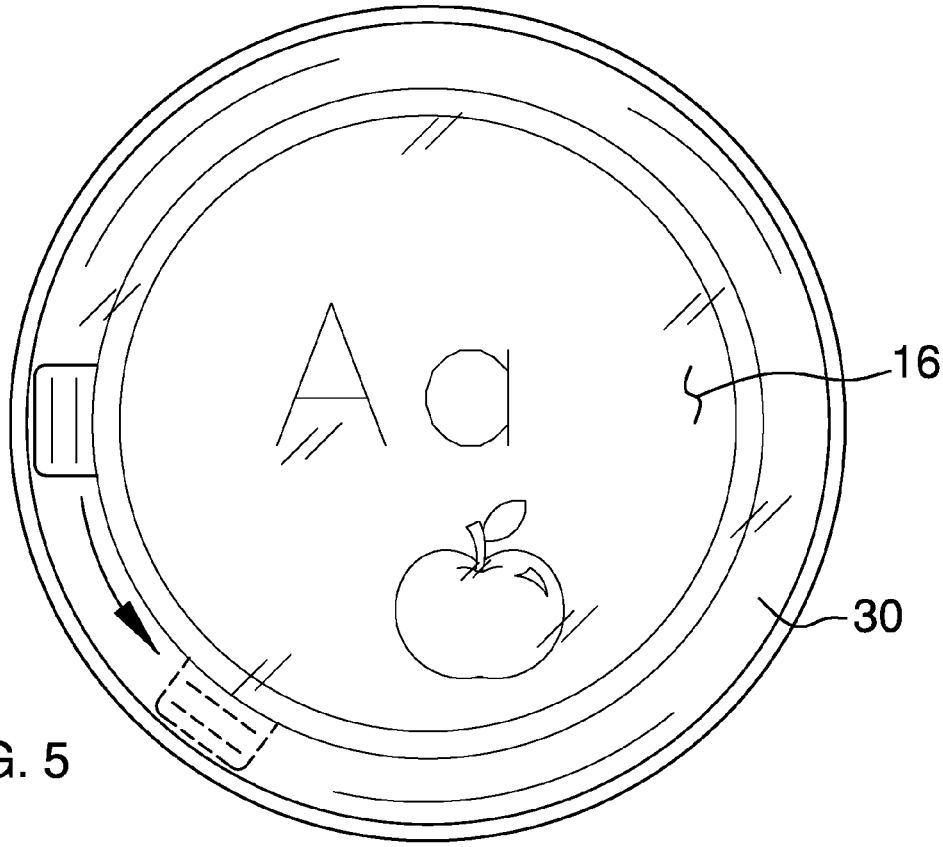
FIG. 5 is a top view of the present invention.
Figure 6:
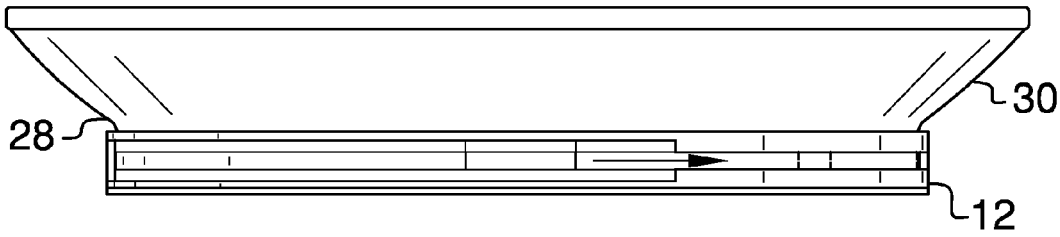
FIG. 6 is a side view of a second embodiment of the present invention.

With reference now to the drawings, and in particular to FIGS. 1 through 8 thereof, a new educational device embodying the principles and concepts of the present invention and generally designated by the reference numeral 10 will be described.

Figure 7:
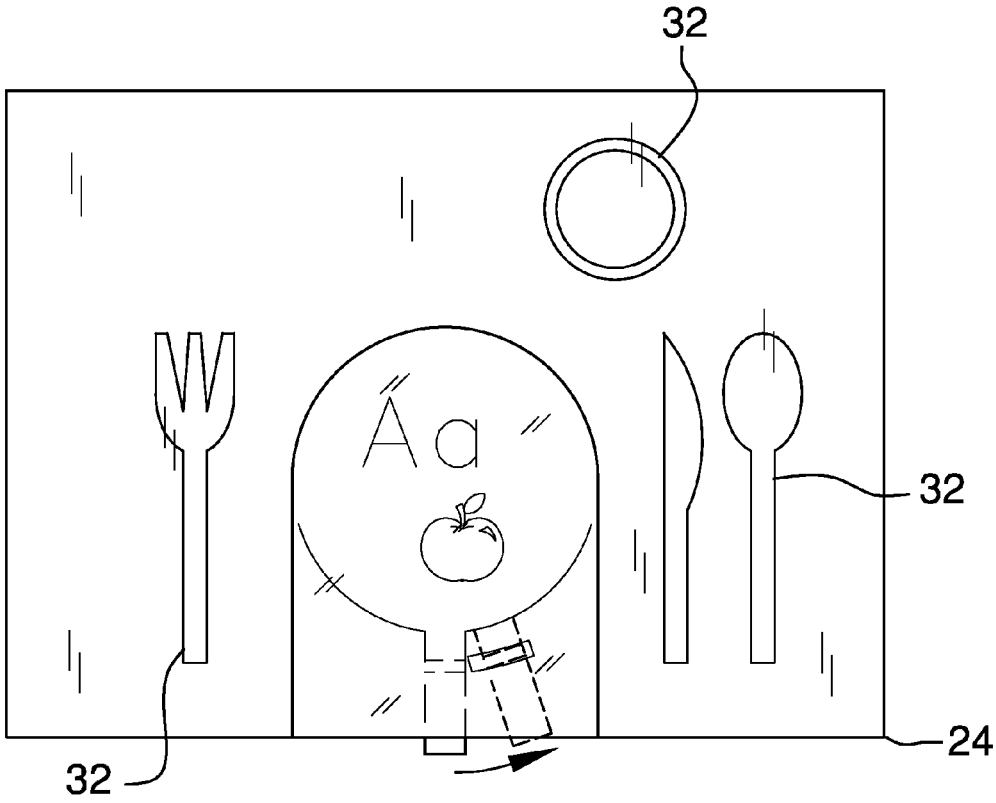
FIG. 7 is a top view of a third embodiment of the present invention.
Figure 8:
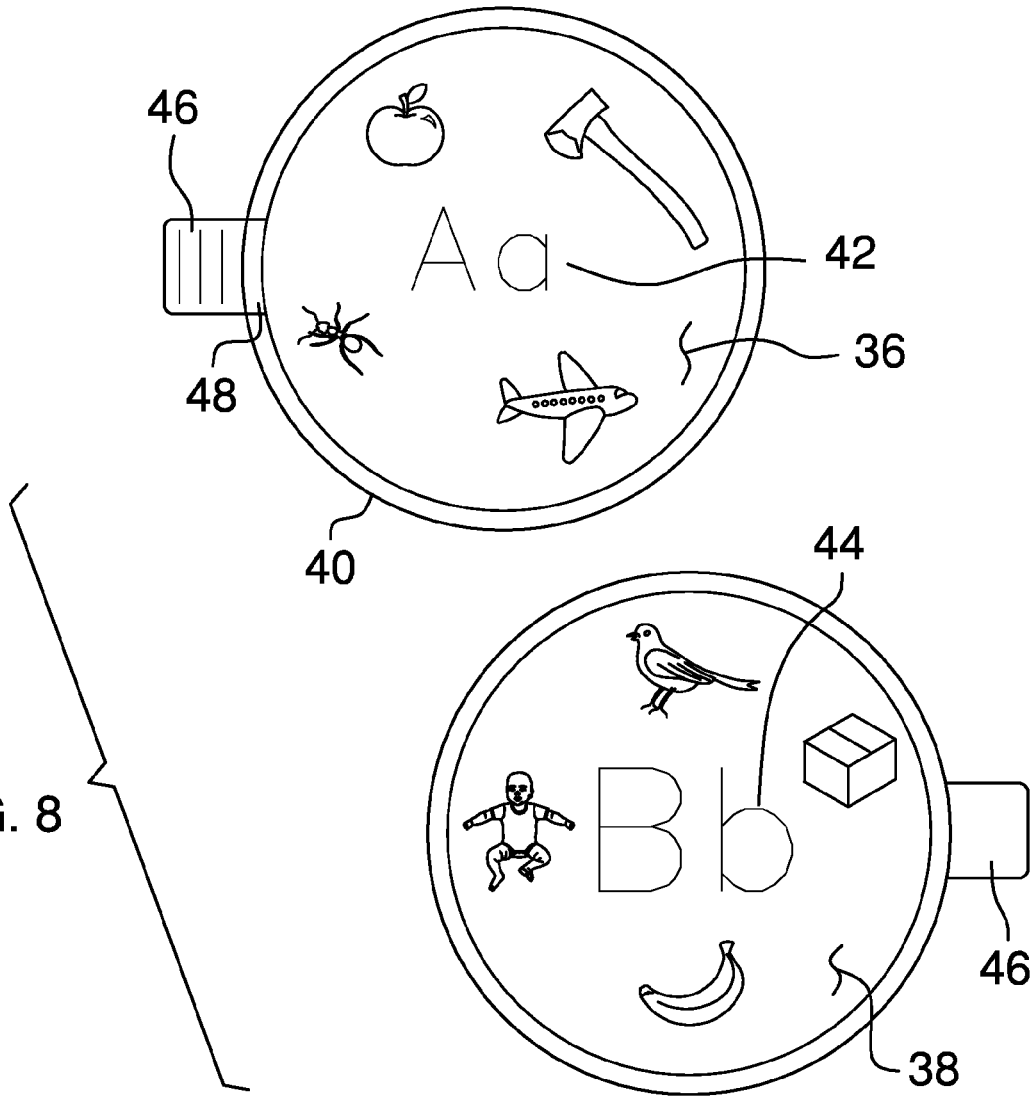
FIG. 8 is a top and bottom view of a plate of the present invention.

As best illustrated in FIGS. 1 through 8, the educational food dish system 10 generally comprises a food supporting member 12 that includes a housing 14 defining a base wall of the food supporting member 12. As shown in FIG. 4A, the housing 14 includes a top wall 16, a bottom wall 18 and a perimeter wall 20 extending between the top 16 and bottom 18 walls. The perimeter wall 20 has a slot 22 therein extending into a space between the top 16 and bottom 18 walls and the top wall 16 is comprised of a transparent material. While the food supporting member 12 may comprise a placemat 24 as shown in FIG. 7, the food supporting member 12 will typically include a bowl 26, FIG. 1, or plate 28, FIG. 6, including a peripheral wall 30 that is attached to and extends upwardly from the housing 12. The placemat of FIG. 7 includes markings 32 for the placement of eating utensils.

A plate 34 has an upper surface 36, a lower surface 38 and an outer edge 40. The plate 34 is removably positioned between the top 16 and bottom 18 walls. Educational indicia 42 are positioned on the upper surface 36 and educational indicia 44 are further positioned on the lower surface 38. The educational indicia 42 on the upper surface 38 differ from the educational indicia 44 on the lower surface 38. The system 10 will include a plurality of plates 34 each having different educational indicia positioned thereon.

A tab 46 is attached to and extends away from the outer edge 40. The tab 46 is gripped to remove the plate 34 from the housing 14. A detent 48 is attached to the plate 34 adjacent to the 46. The detent 48 is removably positioned in a notch 50 in the perimeter wall 20 to releasably lock the plate 34 in the housing 14. The notch 50 is positioned in the slot 22 and the plate 34 rotated with respect to the housing 14 to extend the detent 48 into the notch 50. The notch 50 extends upwardly and downwardly from a plane of the space between the top 16 and bottom 18 walls.

A resiliently compressible pad 52 is attached to and covers a bottom side of the bottom wall 18. The resiliently compressible pad 52 increases friction between the bottom wall 18 and a support surface. The pad 52 may include a plurality of foot members spaced from each other instead of the unitary pad 52.

In use, a plate 34 is chosen and positioned within the housing 14. While a child eats, the plate 34 is viewable through the top wall 16. The plates 34 assist a child in learning letters, reading, math or other information. The detent 48 prevents a child easily removing the plate 34 from the housing 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An educational food dish system comprising:

a food supporting member including a housing defining a base wall of said food supporting member, said housing including a top wall, a bottom wall and a perimeter wall extending between said top and bottom walls, said perimeter wall having a slot therein extending into a space between the top and bottom walls, said top wall being comprised of a transparent material;

a plate having an upper surface, a lower surface and an outer edge, said plate being removably positioned between said top and bottom walls, educational indicia being positioned on said upper surface; and a tab being attached to and extending away from said outer edge, said tab being gripped to remove said plate from said housing, a detent being attached to plate adjacent to said tab, said detent being removably positioned in a notch in said perimeter wall to releasably lock said plate in said housing, said detent extending vertically away from said plate, said detent being rotated with respect to said housing to position said detent in said notch.

2. The system according to claim 1, further including a peripheral wall being attached to and extending upwardly from said housing.

3. The system according to claim 1, further including educational indicia being positioned on said lower surface, said educational indicia on said upper surface differing from said educational indicia on said lower surface.

4. The system according to claim 3, further including a tab being attached to and extending away from said outer edge, said tab being gripped to remove said plate from said housing.

5. The system according to claim 4, further including a detent being attached to said plate adjacent said tab, said detent being removably positioned in a notch in said perimeter wall to releasably lock said plate in said housing.

6. The system according to claim 1, further including a resiliently compressible pad being attached to an covering a bottom side of said bottom wall, said resiliently compressible pad increasing friction between said bottom wall and a support surface.

7. An educational food dish system comprising:

a food supporting member including a housing defining a base wall of said food supporting member, said housing including a top wall, a bottom wall and a perimeter wall extending between said top and bottom walls, said perimeter wall having a slot therein extending into a space between the top and bottom walls, said top wall being comprised of a transparent material, a peripheral wall being attached to and extending upwardly from said housing;

a plate having an upper surface, a lower surface and an outer edge, said plate being removably positioned between said top and bottom walls, educational indicia being positioned on said upper surface, educational indicia being positioned on said lower surface, said educational indicia on said upper surface differing from said educational indicia on said lower surface;

a tab being attached to and extending away from said outer edge, said tab being gripped to remove said plate from said housing;

a detent being attached to said plate adjacent to said tab, said detent being removably positioned in a notch in said perimeter wall to releasably lock said plate in said housing, said detent extending vertically away from said plate, said detent being rotated with respect to said housing to position said detent in said notch; and a resiliently compressible pad being attached to an covering a bottom side of said bottom wall, said resiliently compressible pad increasing friction between said bottom wall and a support surface.

* * * * *